United States Patent [19]

Rangachar

[11] Patent Number: 4,649,061

[45] Date of Patent: Mar. 10, 1987

[54] METHOD OF APPARATUS FOR DEPOSITING OXIDE-CATHODE PRECURSOR MATERIAL ON A CATHODE SUBSTRATE BY AIR SPRAYING

[75] Inventor: Hemmige V. Rangachar, Newtown, Pa.

[73] Assignee: RCA Corporation, Princeton, N.J.

[21] Appl. No.: 736,825

[22] Filed: May 22, 1985

[51] Int. Cl.[4] ..... B05D 1/02

[52] U.S. Cl. ..... 427/78; 118/300; 427/424; 427/427

[58] Field of Search ..... 118/300; 427/78, 424, 427/427; 239/61, 364, 365

[56] References Cited

U.S. PATENT DOCUMENTS

| | | | |
|---|---|---|---|
| 1,196,691 | 8/1916 | Hopkins | 239/365 X |
| 2,943,957 | 7/1960 | Grattidge et al. | 427/78 |
| 3,072,342 | 1/1963 | MacFarland | 239/364 X |
| 3,831,851 | 8/1974 | Gsell et al. | 239/175 |
| 4,169,168 | 9/1979 | Wichmann | 427/78 |
| 4,376,009 | 3/1983 | Kunz | 156/640 |

OTHER PUBLICATIONS

T. N. Chin et al., "Electronic Processes in Oxide Cathodes", *RCA Review* 35, 520–538 (Dec. 1974).

*Primary Examiner*—Shrive P. Beck

*Attorney, Agent, or Firm*—Eugene M. Whitacre; Dennis H. Irlbeck; Vincent J. Coughlin, Jr.

[57] ABSTRACT

Method and apparatus for depositing a layer of oxide-cathode precursor material on a cathode substrate includes passing a slurry of precursor material from a pool of slurry in a closed pressurized vessel through a tubular means to an air spray gun, wherein the tubular means presents a predetermined resistance to the flow of slurry. Compressed gas flowing through the gun produces a fluctuating siphon pressure in the tubular means and produces a spray of slurry which is scanned across the substrate. The flow resistance in the tubular means dampens the fluctuating component of the siphon pressure while the pressure in the vessel overcomes the flow resistance, controls the slurry flow rate, and makes the flow rate less susceptible to variation due to other factors.

5 Claims, 6 Drawing Figures

METHOD OF APPARATUS FOR DEPOSITING OXIDE-CATHODE PRECURSOR MATERIAL ON A CATHODE SUBSTRATE BY AIR SPRAYING

BACKGROUND OF THE INVENTION

This invention relates to a novel method and a novel apparatus for depositing oxide-cathode precursor material on a cathode substrate by air spraying. The coated substrate is subsequently installed in a vacuum electron tube and then, by further processing, converted to an oxide-cathode.

An initial step in preparing an oxide cathode is to deposit a layer of precursor material, usually alkaline earth carbonates, on a cathode substrate, which usually consists essentially of a nickel alloy containing silicon and magnesium. Subsequently, the carbonates of the layer are converted to oxides by thermal decomposition. Then, the converted layer is activated; that is rendered electron emissive by further heat treatment, by which free barium metal is released from the oxides and associated donor centers are formed therein. In order to produce a cathode having optimum amounts of electron emission over a long emission life, it is important to deposit a precursor layer that is highly uniform with respect to porosity, weight and surface texture. The deposition process should produce precursor layers at low cost, be easy to control and be able to provide a high yield of useful cathodes.

Ordinarily, the precursor layer is deposited by air-spraying multiple sublayers of a slurry of the precursor material onto the substrate. The slurry of precursor material is sucked into the air stream in the spray gun through a slurry-supply tube from a pool of slurry in an open vessel. The slurry is drawn into the air stream at the nozzle of the gun by the Venturi effect which produces a siphon pressure in the slurry-supply tube. Because the siphon pressure is relatively low, the slurry-supply tube must have a short length and a relatively large cross-sectional area so that it offers a minimal resistance to the flow of a slurry therethrough.

It has been found that the siphon pressure has a constant pressure component and a fluctuating pressure component. The fluctuating pressure component can be detected at the nozzle of the gun and also at points in the slurry-supply tube all the way back to the slurry vessel. The fluctuating component is believed to be partly responsible for uncontrolled variations in the porosity, unit weight and surface texture produced in the air-sprayed precursor layers. The rate of flow of slurry in this prior method is ordinarily controlled by the position of a needle valve in the spray gun and is significantly affected by the drop in slurry level in the vessel during the spraying operation, and by fluctuations in the siphon pressure.

SUMMARY OF THE INVENTION

The novel method is similar to the prior air-spraying method except that: the slurry-containing vessel is closed to the atmosphere and is pressurized, preferrably with compressed air; and the slurry-supply tube is of such longer length and smaller cross-sectional area as to provide a predetermined resistance to the flow of slurry therethrough. By providing the flow resistance in the slurry-supply tube, the adverse effects of the fluctuating component of the siphon pressure are substantially reduced. Closing and correctly pressurizing the slurry-containing vessel provides a regulated flow rate of slurry to the spray gun, permits the rate of flow of slurry to be controlled by the pressure in the vessel, and compensates for the drop in level of the slurry in the vessel during spraying.

DETAILED DESCRIPTION OF THE PREFERRED EMBODIMENT

Figure 1:
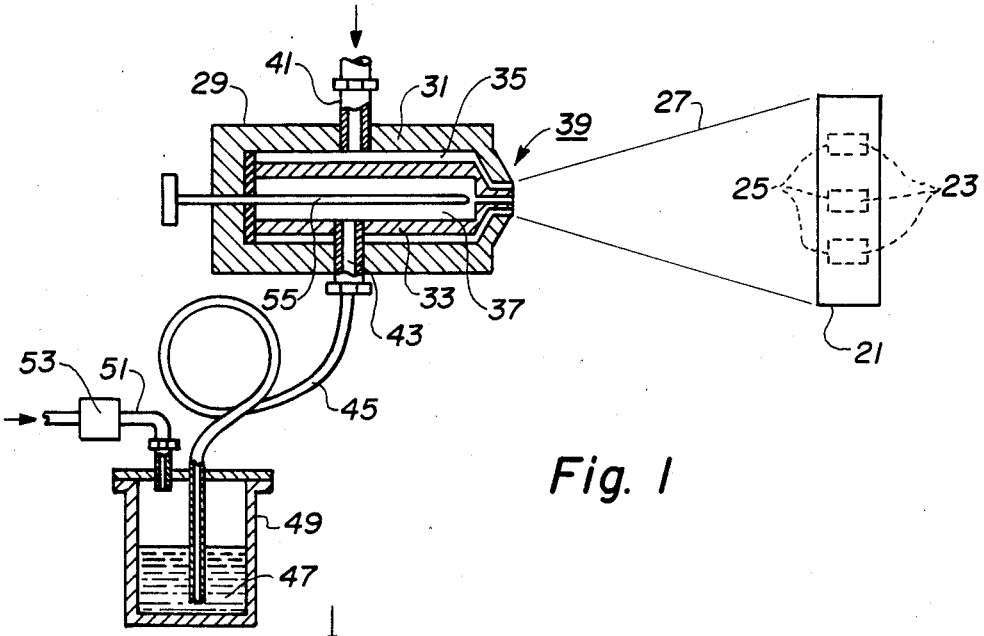
FIG. 1 is a partially-sectional, partially-schematic view of a preferred embodiment of the novel apparatus for practicing the novel method.

FIG. 1 shows a spray bar 21 holding a plurality of cathode substrates 23; for example, 70 units in each of three horizonal rows, with the surfaces 25 to be coated all facing in the same direction. The surfaces 25 are scanned with a spray 27 of slurry from a stationary spray gun 29, by moving the spray bar 21 through the spray 27. As shown in FIG. 1, the spray bar 21 moves away from the viewer. Each pass of the spray deposits a sublayer and at least 3 passes are required to build up the desired layer. Preferrably, 8 passes are used. The number of passes and the weight of material deposited per pass may be adjusted to suit specific needs. Also, the spray bar 21 may be preheated; for example, to 85°±5° C. before spraying, and/or may be cooled and preheated between passes according to a prescribed program.

The cathode substrates may be any of the designs used for oxide-cathodes. In one design, the substrate is the endwall closing one end of a cylindrical cap of cathode nickel that is welded to a sleeve of nickel-chromium alloy. In a preferred design, disclosed in U.S. Pat. No. 4,376,009 to P. J. Kunz, the substrate is the endwall closing one end of a hollow cylinder of nickel-chromium alloy having a layer of cathode nickel over the endwall and a portion of the sidewall. In both designs, the precursor material is deposited on the outside endwall of cathode nickel.

The slurry may be any of the precursor slurries previously used. A typical slurry may consist essentially of carbonate powder 38.7 weight %, nitrocellulose binder 40.9%, diethyl carbonate 12.8%, diethyl oxalate 6.6% and ethyl alcohol 1.0%. The slurry is adjusted to contain about 0.535 to 0.565 grams/mL of solids and have, at 22° to 25° C., a specific gravity of about 1.38 to 1.41, a viscosity of about 25.0 to 40.0 cps at 60 rpm (Brookfield) and a consistancy of about 34.0 to 42.0 seconds (#1 Zahn Cup). The carbonate powder is a triple carbonate of barium, strontium and calcium with a mean particle size of about 1.65 to 1.95 microns (Coulter Counter).

Figure 3:
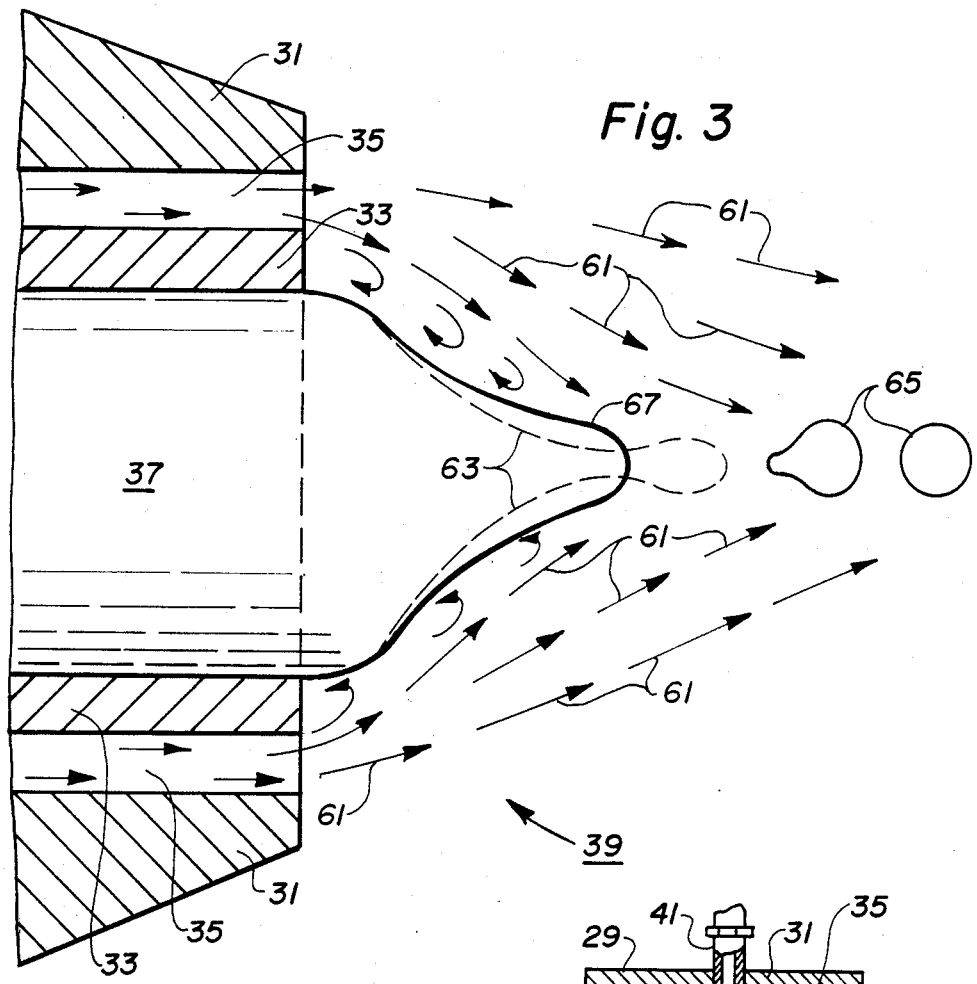
FIG. 3 is an enlarged sectional view of a spray nozzle showing the breaking of a stream of slurry into droplets.

The spray gun 29 comprises an outer jacket 31 and an inner jacket 33 defining an outer annular compressed-air chamber 35 and an inner cylindrical slurry chamber 37, each of which terminates at one end thereof in a spray nozzle 39 shown in enlarged detail in FIG. 3. The outer chamber 35 is supplied with compressed air at about 40 to 70 psi (275.8 to 482.6 rPA) through a compressed-air supply duct 41. The inner chamber 37 is supplied with precursor slurry through a slurry-supply tubular means including a slurry duct 43 connected to the inner chamber 37 and a slurry-supply tube 45 of the prescribed length and cross-sectional area. In this example, the slurry-supply tube 45 is about 36 inches (91.44 cm) long with about a 1/16 inch (0.159 cm) diameter bore. The slurry-supply tube 45 is connected at one end to the slurry duct 43 and the other end extends into a pool 47 of precursor slurry contained in a closed vessel 49. The vessel 49 is pressurized to controlled pressures greater than atmospheric pressure with compressed air or other gas from a source (not shown) through a pressure duct 51 and a pressure regulator 53. The pressure in the vessel 49 should be sufficient to cause a substantial flow of slurry through the tubular means. The rate of flow of slurry into the gun is controlled by the pressure in the vessel 49 and by the flow of compressed air through the spray gun 29. The spray gun 29 also has a needle valve 55 which permits the supply of slurry to be turned off or on, but does not otherwise control the flow of slurry. A typical value of pressure in the vessel 49 is about 28 psi for the above-mentioned slurry-supply tube 45.

Figure 2:
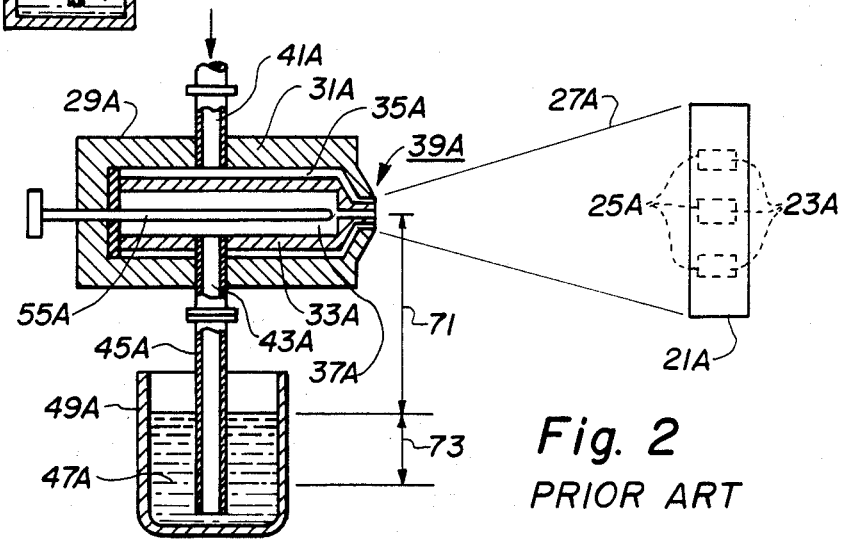
Fig. 2 PRIOR ART
FIG. 2 is a partially-sectional, partially schematic view of an embodiment of a prior-art apparatus for practicing a prior-art method.

The foregoing embodiment of the novel apparatus and novel method is to be compared with a prior apparatus and method exemplified in FIG. 2. In that prior apparatus, the spray bar 21A and spray gun 29A are essentially the same as in FIG. 1 except that the needle valve 55A in the spray gun 29A and the flow of air in the spray gun 29A control the flow of slurry through the spray gun 29A. The pool 47A of precursor slurry is in a vessel 49A that is open to the atmosphere. Slurry is drawn into the spray gun 29A by the siphon pressure that is produced by the Venturi effect as the compressed air rushes through the nozzle of the spray gun as shown by the arrows 61 in FIG. 3. The suction or siphon pressure draws out the slurry in the inner chamber 37 as shown by the dashed lines 63 until a portion breaks off, forming droplets 65 and a new external shape 67 due to the surface tension of the slurry.

It is believed that the turbulent expansion of the air flow through the annular region in front of the nozzle 39, the sweeping action of the boundary layers of the streams of air, the breaking off of droplets 65 and the forming of a new shape 67, cause a fluctuating siphon pressure component in the stream of slurry in the inner slurry chambers 37 and 37A and in the slurry-supply tubes 45 and 45A. This fluctuation can be detected all the way back to the pool 47A in the prior-art apparatus, and is believed to be an important cause of physical variations in the coatings deposited on the substrates 25A on each spray bar. These fluctuations are greatly reduced in magnitude in the slurry-supply tube 45 of the novel apparatus which results in less variation in the physical characteristics of the coatings deposited on the substrates 25.

It is noteworthy that, in the prior apparatus, the sole force moving the slurry through the inner slurry chamber 37A and the prior slurry-supply tube 45A is the siphon pressure developed at the nozzle. With 40 to 70 psi of air pressure, the constant pressure component of the siphon pressure is about 1.2 to 1.8 psi. This requires the prior slurry-supply tube 45A to produce a minimal resistance to the flow of slurry. A common size of a prior slurry-supply tube 45A is about 8 inches in length with an 0.25 inch bore, which is a much shorter and a much larger bore than the slurry-supply tube 45 of the novel apparatus.

Also, because of the low siphon pressure, the prior apparatus is limited to a very short lift (shown by the arrow 71 in FIG. 2), whereas the novel apparatus is not so limited. Furthermore, as the surface level of the slurry pool 47A of the prior apparatus drops, the drop (shown by the arrow 73) is added to the required lift, adversely affecting the rate of flow of slurry. Because the slurry pool is in a pressurized vessel and with correct pressurization of the vessel, the position of the vessel and the surface level of the slurry pool can be made substantially independent of siphon pressure. Also, the pressure in the vessel 49 controls the rate of flow of slurry, which is more constant and more easily controlled than with the position of the needle valve 55A of the prior apparatus.

Another advantage of the novel apparatus and novel method over the prior apparatus and method is that it is much more amenable to computerized process control. This is because the pressurized slurry vessel provides an additional control and also widens the process latitude on other process parameters.

Figure 4:
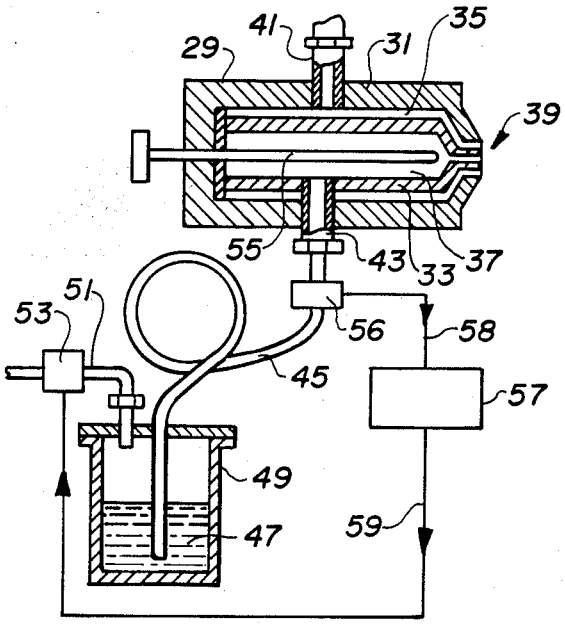
FIG. 4 is a view of the preferred embodiment as shown in FIG. 1 modified to include a feed-back slurry-flow-rate control system.

A simple control arrangement, shown in FIG. 4, maintains the flow of slurry through the spray gun constant, even though the slurry viscosity or other factors may change the flow-rate of slurry with time. The embodiment shown in FIG. 4 includes all of the structures shown in FIG. 1 with the same reference numerals, and additionally includes a flow meter 56 between the slurry duct 43 and the slurry-supply tube 45, a pressure controller 57 connected to the flow meter 56 by an input connection 58 and connected to the regulator 53 by an output connection 59. The flow of slurry in the long, narrow slurry-supply tube 45 is measured by the flow meter 56 and generates a series of sample signals which are representative of the rate of flow of slurry with respect to time. The sample signals are fed to the controller 57 (either an analogue or a digital computer). The controller 57 compares the values the series of sample signals with the set point flow value that is desired, and generates a series of error signals with respect to time. The series of error signals are converted to a corresponding series of control signals, which are then fed to the pressure regulator 53, such that the pressure in the vessel 49 is increased or decreased appropriately to achieve the desired flow rate. This form of control prevents the weight of the coating that is deposited on the cathode substrates from drifting away from a predetermined value based on the flow rate of slurry through the gun.

Figure 5:
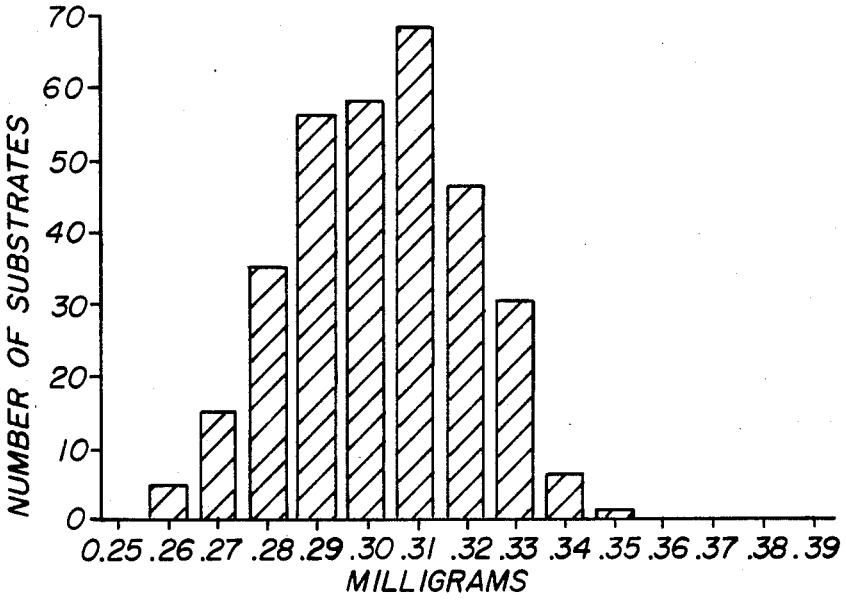
FIG. 5 is a histogram of dry coating weights produced by the novel method in the novel apparatus shown in FIG. 1.
Figure 6:
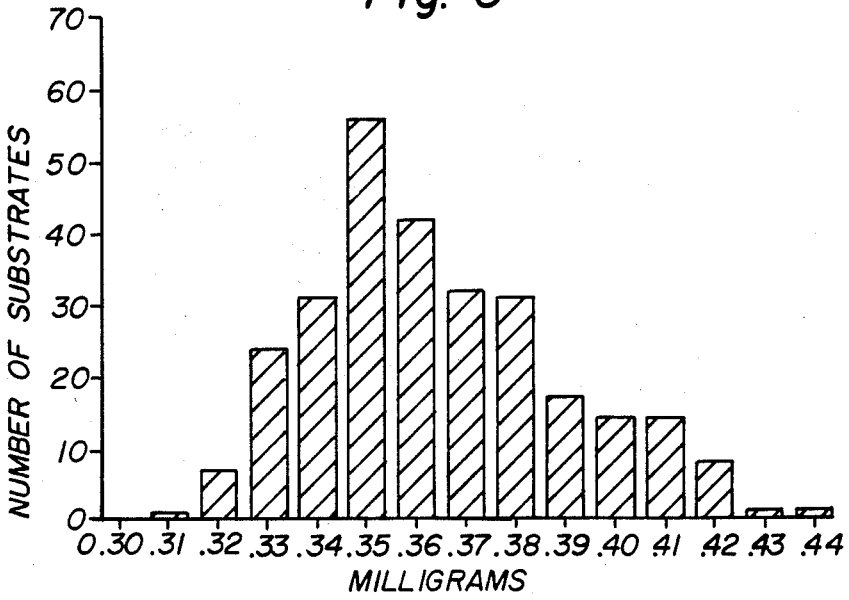
FIG. 6 is a histogram of dry coating weights produced by a prior method in the prior-art apparatus shown in FIG. 2.

The histograms shown in FIGS. 5 and 6, from a controlled experimental run, demonstrate the improvement in uniformity achieved with the novel method. In each case, substrates were loaded into a spray bar that was preheated to 70° C. and were coated under identical conditions 8 times, each time with a single pass of the same slurry spray followed by drying in a drying tunnel. FIG. 5 summarizes the coating weights of dry solids deposited on substrates sprayed with the novel apparatus shown in FIG. 1 with the vessel 49 pressurized at 36 psi. FIG. 6 summarizes the coating weights of dry solids deposited on substrates sprayed with the prior art apparatus shown in FIG. 2. Clearly, the dry coating weights shown in FIG. 5 are bunched over a narrower coating weight range than the product shown in FIG. 6. Similar results were recorded in histograms of coating thicknesses, showing a narrower thickness range in the coatings produced by the novel method as compared with the coatings produced by the prior method.

Thickness measurements are subject to interpretation because the dry coatings are not solid, but are piles of long rice-like crystals about 2.8 microns across and 10 microns long. The average thickness built up in a single spray pass is about 10 microns or about 3 to 4 crystals high. Magnified views of the coatings, shown for example by T. N. Chin et al., "Electronic Processes in Oxide Cathodes", *RCA Review* 35, 520–538 (1974), indicates that the coatings are full of pores, which are desirable for the good performance of the converted coatings as electron emitters. The spray method of coating is preferred because of its ability to produce micropores. The novel method is believed to produce coatings with less variation in the number and sizes of micropores.

What is claimed is:

1. A method for depositing a layer of oxide-cathode precursor material on a cathode substrate comprising passing a slurry of said precursor material from a pool of said slurry in a closed vessel through a tubular means to an air-spray gun, said tubular means presenting a predetermined resistance to the flow therethrough of said slurry, producing a controlled pressure in said closed vessel that is substantially above atmospheric pressure, said vessel pressure controlling the rate of flow of said slurry to said gun, flowing compressed gas through said gun in such manner as to produce a siphon pressure in said tubular means and to produce a spray of said slurry, and scanning said spray across the surface of said substrate, wherein said siphon pressure includes a constant pressure component and a fluctuating pressure component, and said predetermined resistance is sufficient to reduce the effects of said fluctuating pressure component on the slurry in said tubular means.

2. The method defined in claim 1 wherein said predetermined resistance is substantially greater than the resistance against which said siphon pressure alone can draw slurry through said tubular means with said vessel pressurized at atmospheric pressure.

3. The method defined in claim 1 wherein said tubular means includes a slurry-supply tube having a circular bore of about 62.5 mils (0.159 cm) and a length of about 36 inches (91.44 cm) and said controlled pressure is about 28 to 36 pounds per square inch.

4. The method defined in claim 1 wherein a layer of precursor material is deposited on each of a plurality of like cathode substrates, said deposited layers being substantially uniform with respect to porosity, unit weight and surface texture, including mounting said plurality of substrates in a spray bar with all of the surfaces to be coated exposed and facing in the same direction, maintaining said spray in a stationary position, and passing said exposed surfaces through said spray a plurality of times.

5. The method defined in claim 4 wherein said exposed surfaces pass through said spray at least three times.

* * * * *